United States Patent [19]

Poitte

[11] 4,175,108

[45] Nov. 20, 1979

[54] PROCESS FOR EXTRACTING URANIUM FROM ORES

[75] Inventor: Jacques Poitte, Rambouillet, France

[73] Assignee: Societe Technique des Entreprises Chimiques, Sevres, France

[21] Appl. No.: 793,553

[22] Filed: May 4, 1977

[30] Foreign Application Priority Data

May 31, 1976 [FR] France ..... 76 17171

[51] Int. Cl.[2] ..... C01G 43/00

[52] U.S. Cl. ..... 423/20; 423/3

[58] Field of Search ..... 423/3, 20

[56] References Cited

U.S. PATENT DOCUMENTS

| | | | |
|---|---|---|---|
| 2,767,045 | 10/1956 | McCullough | 423/253 |
| 2,830,872 | 4/1958 | McCullough | 423/10 |
| 3,488,162 | 1/1970 | Sierzputowski | 423/20 |
| 3,808,306 | 4/1974 | Smith et al. | 423/20 |
| 4,017,309 | 4/1977 | Johnson | 423/20 |

OTHER PUBLICATIONS

Brown, et al., "Proc. Second U.N. Intl. Conf. Peaceful Uses of Atomic Energy," vol. 3, p. 196, United Nations, (1958), Geneva.

*Primary Examiner*—Edward A. Miller

*Attorney, Agent, or Firm*—Dennison, Dennison, Meserole & Pollack

[57] ABSTRACT

A process for the extraction of uranium from ores which is an improvement in the known "dry attack" treatment of uranium ores to an economical yet high rate of extraction. The process concerns solubilization of the uranium contained in the ores and consists of carrying out digestion of the mixtures of ore and reagent, with the possible addition of oxidizing agents. The process is carried out on an improved trough type of conveyor belt at predetermined conditioning of temperatures and humidity.

9 Claims, 3 Drawing Figures

PROCESS FOR EXTRACTING URANIUM FROM ORES

This invention concerns a process for treating the ores of uranium in order to extract this metal which is generally present in a very small quantity, with a high yield of extraction and under very economical conditions.

This improved process constitutes an improvement to the so-called "dry attack" method of treating uranium ores, i.e. in a very concentrated medium in which the quantities of water used are restricted to the minimum requirement when the properties of the ore make this possible.

The so-called "dry" method for treating uranium ores which is now well-known was disclosed by R. GAUTIER'S document "Perspectives nouvelles dans le traitement des minerais d'uranium" (new prospects in the treatment of uranium ores)—IAEA conference on the treatment of ores containing uranium in Sao-Paulo (Brazil) 17th to 21st August, 1970—IAEA SM—135/38. This document shows that it is possible to solubilize uranium by a selective attack of the phase or phases which contain it while at the same time not attacking the majority of the ore which does not contain uranium. In fact, the uranium ores contain a majority of very hard constituents such as silica, which are only attacked slightly by the reagents intended to solubilize the uranium.

On the other hand, the uranium is present in various forms in the midst of much less hard constituents. By crushing these ores relatively coarsely, the phases containing uranium may be brought to a degree of fineness which is sufficient for an internal chemical attack to solubilize the uranium while at the same time maintaining the particles of hard substances which do not contain uranium sufficiently coarse to restrict their attack and to save energy and the attacking reagent.

This so-called "dry" process is carried out in the most general manner by the following stages:

1. Crushing of the ore carried out so as to only release the hardest particles which constitute a large portion of the ore:

This corresponds to a maximum size which is usually between 0.5 and 2 mm.

2. Mixing with the attacking solution:

The composition of this solution depends upon the nature of the ore to be treated. These are usually sulphuric solutions, sometimes hydrochloric solutions. If the ore contains large quantities of carbonates, alkaline solutions are then preferably used. The concentration of these solutions depends of course upon the nature of the phases which are to be solubilized and upon their content in the ore. A sufficient quantity of reagent of solubilizing almost all of the uranium, without too great an excess, should be introduced.

There should be a sufficient quantity of solution to allow all of the constituents of the mixture to be wetted as well as for the reagent to be diffused within the grains containing uranium compounds while at the same time preventing a continuous liquid phase from being formed.

The prior art document mentioned above gives an example of ores treated with concentrated sulphuric attacking solutions which may contain up to 0.7 t/m$^3$ of $H_2SO_4$, at the rate of about 100 l per metric ton of ore.

On an industrial scale, mixing is carried out in a rotating drum in which the ore and the attacking solution are simultaneously introduced. Sufficient mixing is obtained within several minutes. Live steam may also be introduced to raise the reaction temperature.

3. Digestion:

Since crushing is not very thorough for the reasons given above, the particles containing uranium are not very fine. Furthermore, and most important of all, the fact that there is not a continuous liquid film restrains the diffusion of the dissolved phases in the midst of the liquid and also the diffusion of the attacking reagent in the direction of the compounds containing uranium.

Therefore, if the largest possible quantity of uranium is to be solubilized, it is necessary to guarantee a sufficiently long period of contact in suitable conditions of temperature and humidity. This digestion may be carried out statically for periods in the order of several hours at temperatures in the order of 60° to 100° C.

R. GAUTIER'S paper shows that residence of about 2½ hours in a rotating digester produces yields above 95%. For certain ores, particularly reducers, it is necessary to add an oxidizing agent such as sodium chlorate, manganese dioxide, ammonium nitrate, hydrogen peroxide etc., to the attacking solution in order to solubilize a sufficiently large percentage of the uranium content. This should preferably be added during digestion when using an oxidizing agent whose action is impaired by too great a free acidity (Na $ClO_3$ for example).

4. Extraction of the solubilized uranium. This operation generally consists in placing the ore mixture, after digestion, in contact with a washing solution into which the uranium passes, then in separating this solution from the solid phase. Very efficient washing may for example be carried out by means of band filters, using the counterflow washing method which is well-known to those skilled in the art, thus allowing the consumption of washing solution to be restricted and relatively concentrated liquors having very high yields of extraction to be obtained. The final concentration is several grams of uranium per liter.

Digestion is one of the most important steps of the process just described and must be carried out for a long enough period in well determined conditions of temperature, volume and concentration of the attacking solution. In addition, in many cases the oxido-reduction potential of this solution must be controlled not only at the beginning of the attack but preferably during the attack in order to create the most favorable conditions for solubilizing the uranium. In industrial practice, the static or rotating digesters have the disadvantage of large dimensions owing to the huge quantities of ore which must be treated and the required residence times. Thus, to treat for example 50 t of ore per hour, an apparatus capable of containing 150 t is required if an average residence time of 3 hours is desired. It is very expensive to construct apparatus of such volume and considerable problems arise with regard to installing them on sites which are often a very long way from communications. It is also difficult to design apparatus based on discontinuous operation. In fact, if a capacity is filled relatively easily with several tens of metric tons or with several hundred metric tons of crushed and humid matter, it is much more difficult to then extract this matter taken more or less in mass in order to send it to the washing installation. Furthermore, it is difficult to control the conditions of temperature and the optimum conditions for oxidizing the mixture in very thick layers. Finally, the problems of corrosion by the attacking solution are very serious in static apparatus.

For these reasons, continuous digesters, generally tubular, are preferred in which the mixture of the ore and the attacking solution is introduced at one end whereas the mixture leaves at the other end after the digestion period.

A digester of this type is for example formed by a smooth tube of about 4 m in diameter and 35 m in length, having an axis which is slightly inclined to the horizontal. This tube is supplied at the highest end at a rate of approximately 40 to 50 t/hour with mixture which flows to the outlet in the same rhythm. A filling rate of 30 to 35%, that is 120 to 150 t of matter, is obtained by regulating the threshold of the outlet. The rotation of the tube guarantees that the matter is moved forward from one end to the other.

However, experience has shown that in a digester tube of this type, the mass of ore which is rotated does not crumble evenly but in bursts, owing to the pasty consistency of the mixture. These bursts are transmitted to the drive mechanism which is suddenly overloaded, often to beyond the calculated stresses. Permanent deformations of the tube may even be produced. This material is therefore subjected to considerable wear resulting in high maintanence costs and a noticeable percentage of out of gear time.

Furthermore, it is extremely difficult to correctly control the oxido-reduction potential of the attacking solution in a digester of this type. In fact, if it is relatively easy to control the redox potential by introducing a small quantity of ore in the water at the outlet of the digester, this potential must be adapted for frequent correction during digestion itself by adding an oxidizing solution when the ore contains reducers. A device for introducing the oxidizing solution into the digester must therefore be controlled by the degree of redox potential.

But if the oxidizing solution contains, for example, sodium chlorate, it will be almost completely decomposed in the event of the ore being attacked by a concentrated sulphuric solution. This means that the introducing device would have to be installed inside the rotating digester, at a certain distance from the inlet, so that the concentration of free sulphuric acid from the attacking solution will have been reduced considerably. This gives rise to great problems which cannot be solved very well. It is thus senn that such a rotating digester is not suitable for treating ores to which an oxidizing agent must be added. These ores are, in particular, the ones which contain iron in the ferrous state, this often being the case.

In order to avoid all of these problems, the possibility of carrying out digestion in completely different conditions has been examined. It has seemed that it should not be necessary to mix the ore with the attacking solution permanently and if initial mixing, which only lasts several minutes, was carried out correctly, it would not be worthwhile continuing mixing. It has also appeared to be preferable to prevent the mixture from accumulating in layers which are too thick, as this could impair satisfactory control of the conditions of the reaction between the attacking solution and the ore. Attempts have therefore been made to construct a new type of digester in which the attacking process could be controlled as it takes place and be adjusted if necessary by making suitable additions. The possibility of easily adapting the attacking conditions to the quanlity of the ores or to their granulometry has also been sought, by acting upon the duration of the process and also upon other factors such as the quantity and the concentration of the liquid phase and the temperature.

The process which forms the subject of the invention unexpectedly consists in carrying out the digesting operation of a conveyor belt by establishing the physico-chemical conditions required for attaining the desired result right along the path of the belt. It is known that such belts may be used for manufacturing superphosphate, in order to complete the reaction for forming these superphosphates after crushing the phosphate very thoroughly and after mixing with the sulphuric or phosphoric acid. In these conditions, the reaction which is completed on the belt only lasts several minutes or several tens of minutes and only requires relatively simple conditions for carrying it out. In the present case, the residence time on the belt is of the same order of magnitude as that required in a rotating digester, that is generally more than one hour and preferably two to three hours, possibly more.

The temperature of the mixture on the belt must be of the same order of magnitude as that which prevails in a digester, that is, generally between 60° and 100° C. In order to avoid excessive loss of heat and of humidity, the belt is covered with an insulating hood which encloses the charge which is conveyed by the belt in a semi-sealed manner. The non-limitative examples below describe two embodiments of the process which forms the subject of the invention.

The following figures allow the characteristics of the process and the apparatus used for carrying out the process to be understood better.

IN THE DRAWINGS

EXAMPLE 1

Figure 1:
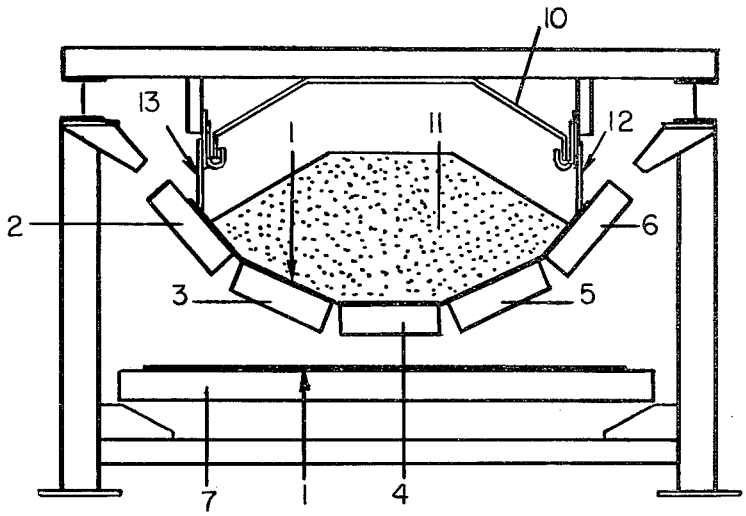
FIG. 1 is a transverse section through a conveyor belt according to the invention with its charge of an ore plus reagent mixture and its hood.
Figure 2:
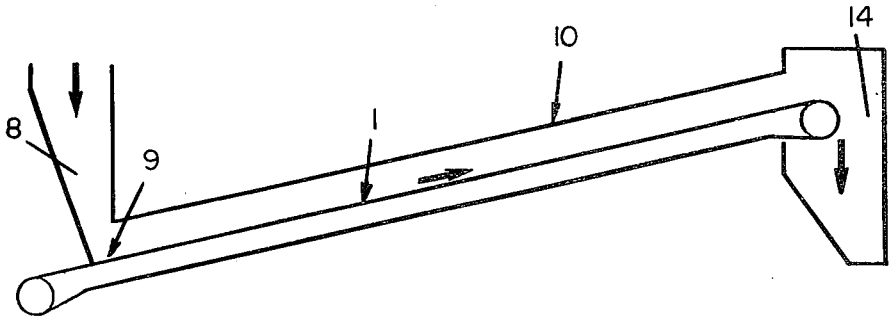
FIG. 2 is a diagrammatic view of the belt assembly in FIG. 1 with its hood and its loading and unloading apparatus.

As shown in FIG. 1, the endless belt 1, made of rubber, is supported across its width by five rollers 2, 3, 4, 5 and 6 which give it the trough-like profile shown. This belt is 2.5 m wide, 100 m long and travels at a speed of about 0.5 m/min. The residence time of the charge on the belt is therefore of the order of 3 hours. An aqueous solution of sulphuric acid containing in the order of 0.5 to 0.7 t of $SO_4H_2$ per cubic meter is added to the ore which is coarsely crushed as described at the beginning, according to the properties of the said ore, at the rate of about 0.1 $m^3$ of solution per metric ton of ore.

After residing for several minutes in a rotating mixer (not shown) which disperses the acid solution in the midst of the ore, the latter is continuously discharged, by means of the loading funnel 8, into the zone 9 of the belt 1 situated near to the starting point of the latter. The flow rate of the mixture is about 50 t/h and its temperature about 60° to 100° C. It is distributed on the belt as shown by 11 in the form of a layer, the thickness of which depends upon the density of the ore and upon its granulometry. The spacing and the size of the support rollers as well as the properties of the belt are determined in a manner known to those skilled in the art in relation to the charge which is of the order of 1.7 t per linear meter of belt. The return side of the belt 1 is supported by rollers such as 7 which extend over the entire width. The hood is formed by sandwich panels 10 comprising external walls made of stainless steel and an internal insulator such as expanded plastic. The panels are extended along the edges by flexible skirts made of rubber 12 and 13 which seal the space between the fixed panels and the edges of the moving belt at least partially so as to reduce the exchanges with the external atmosphere to the minimum. After travelling along the distance separating the loading zone 9 from the upper end in about 3 hours, the mixture reaches the latter and is discharged into the unloading funnel 14 which allows it to be transferred to the washing installation (not shown).

The embodiment of the process according to the invention which has just been described in this example allows the rotating digester to be dispensed with, this apparatus being cumbersome and expensive, difficult to transport on to sites which are a long way from communications and also difficult to maintain and to repair.

The apparatus according to the invention which replaces it is, on the other hand, of simple design, easy to install in situ and comprises interchangeable elements which may be replaced in the event of a breakdown. It also enables the reaction between the ore and the attacking solution to be carried out in conditions which are much more favorable than those of former methods. In fact, as described above, it is possible to regulate the operating conditions in relation to the physico-chemical properties of the ores which are to be used and also to the crushing and mixing conditions which may evolve in relation to the requirements. It is also possible to modify the temperature conditions right along the belt. In particular, the mixture could be heated for example towards the upper portion of the belt by injecting live steam, or by using heating panels comprising a circulation of hot liquid in a double wall. The residence time on the belt may also be easily regulated by modifying the speed of the latter.

In order to treat certain types of reducing ores, such as those which contain ferrous salts, it is important to be able to introduce an oxidizing solution into the mixture to allow the uranium to be brought to valency 6 in order to facilitate its dissolution. Manganese dioxide in powder form or aqueous solutions containing for example sodium chlorate, or ammonium nitrate, or hydrogen peroxide, or any other oxidizing agent or stuiable mixture of oxidizing agents are generally used. As stated at the beginning it is often preferable to wait until the quantity of free acid in the mixture has been greatly reduced before introducing this oxidizing solution. In certain cases, the mixture could be sprinkled directly onto the belt, a certain distance from the starting point, by means of an oxidizing solution. In this case, it is difficult to wet the charge suitably and there is a risk of considerable discharges of solution along the belt. The second embodiment of the invention according to the example below allows these disadvantages to be avoided.

EXAMPLE 2

The embodiment of the process according to the invention described in this example applies to ores having physico-chemical properties which are comparable to those of the ores whose treatment on a belt has just been described, but which contain reducers such as ferrous salts.

Figure 3:
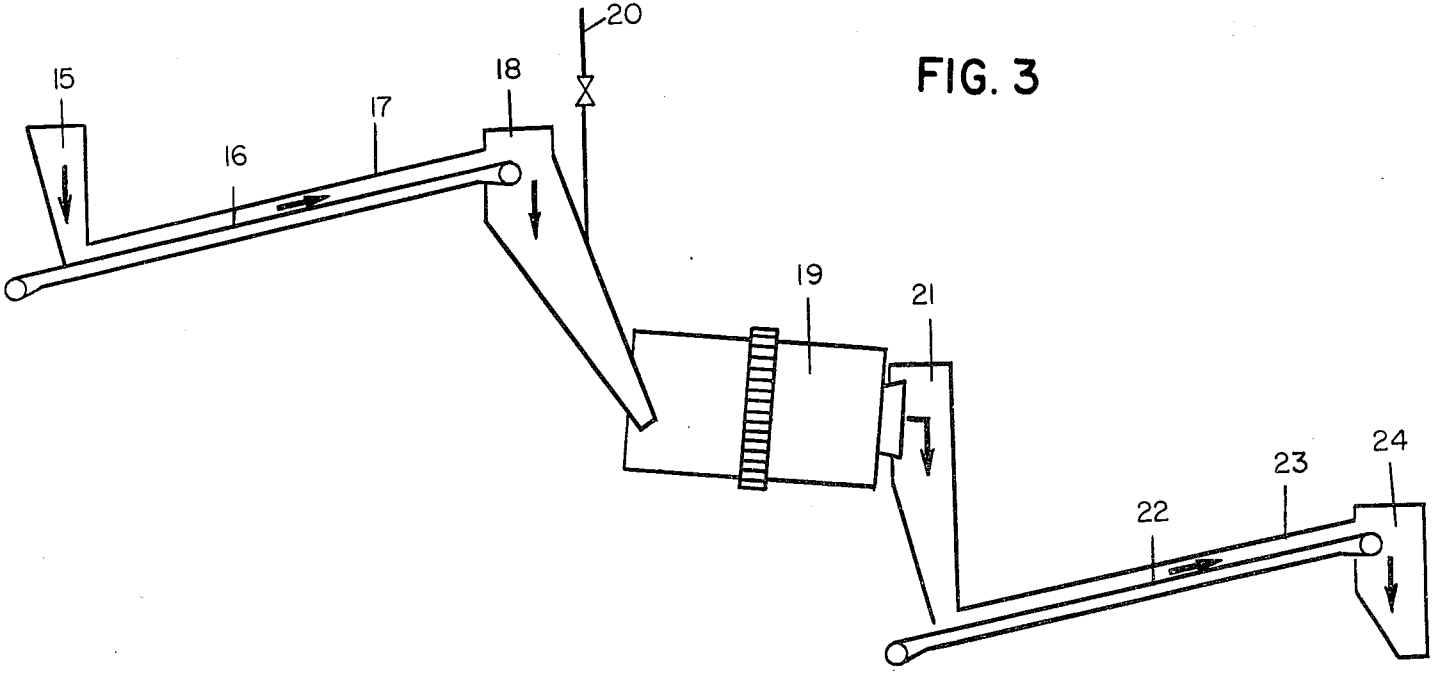
FIG. 3 represents another embodiment of the process according to the invention in which the belt is divided into two successive lengths with an intermediary mixer.

After crushing such a reducing ore coarsely in the conditions which have been described at the beginning, the ore is impregnated with an aqueous sulphuric acid solution containing 0.5 to 0.7 t of $H_2SO_4$ per cubic meter according to the physico-chemical properties of the said ore at a rate of 0.1 $m^3$ of solution per metric ton of ore. After mixing in the conditions described in Example 1, the ore which is impregnated with acid (see FIG. 3) is discharged by means of a funnel 15 on to a belt 16 which is 2.5 m wide, 30 m in useful length and travelling at 0.5 m/min. The flow rate of the mixture is about 5 t/hour and its temperature at the inlet is 60° to 100° C. The travelling time on this belt is of the order of 1 hour. A hood 17 having similar properties to those described in Example 1, allows the losses of heat or of humidity of the charge to be reduced. At the outlet of the belt 16, the mixture is discharged through the funnel 18 into a rotating mixer 19 of a known type, comparable to the one used for producing the initial mixture. An oxidizing solution of sodium chlorate whose chlorate concentration is regulated in relation to the ore's content of reducing elements is simultaneously introduced into this mixer by means of the pipe 20 which penetrates the funnel 18. This regulation is carried out so as to obtain a solution of uranium having a well determined oxido-reduction potential when the ore is washed. The quantity of oxidizing solution to be introduced in this way depends upon the properties of the crushed mixture. It must be such that there is no considerable excess of liquid in relation to the quantity which can be retained by the mixture. Therefore, it may be sufficiently large to allow good impregnation. For this reason, it is expedient that the quantity of liquid introduced is only slightly smaller than the quantity required for creating a continuous liquid phase in the midst of the solids.

Simple practical tests allow the optimum quantity of solution to be determined in relation to the properties of the ore and to the quantity of attacking solution which has already been introduced. It is generally of the order of 30 to 50 liters per metric ton of ore. After several minutes of residence in the mixer 19, the product is discharged through the funnel 21 on to the belt 22. This has properties which are comparable to those of the belt 16 except for the length in this case. Like the belt 16, it comprises a hood 23. Its speed of travel is the same and its useful length is 60 meters. After about 2 hours of residence, the mixture is discharged into the funnel 24 which leads it to the washing installation (not shown).

It is seen that the arrangements adopted allow the digestion process on a belt to be adapted very effectively to the treatment of reducing ores. The intermediary rotating mixer 19 which allows the oxidizing solution to be introduced is an apparatus whose capacity may be restricted to only several metric ton of product, like that of the initial mixer, since the residence time may be limited to the few minutes required for the solution to be distributed sufficiently in the midst of the mixture to prevent discharges to the outside and to facilitate later diffusion. This intermediary impregnation may be carried out by other means apart from a rotating mixer. In particular, the mixture may be wetted on a filter. In this case, the mixture which has undergone a first digestion phase on a first belt is discharged over a movable band filter upon which it is sprayed by the oxidizing solution. The quantities of solution which pass through the filter are recovered by a pump and pulverized on the mixture again. As in the previous case, the quantities of solution introduced are regulated so that the liquid phase is retained in a practically integral manner by the mixture, and the concentration of oxidizing agent in this solution is also regulated so as to maintain the oxido-reduction potential at the desired level when the solution containing uranium is extracted by washing. When leaving the band filter, the mixture falls on to a second belt, upon which the second digestion phase takes place, and it is then transmitted to the washing area for extracting the solubilized uranium.

Washing may be carried out by any conventional method, the choice of which may depend to a certain extent upon the physico-chemical properties of the ore and the local conditions. As stated above, the well-known method of counterflow washing on a band filter may be used in particular and this can be preceded or not preceded by the suspension of the mixture in a continuous solution in an agitated tank. But it has appeared to be particularly worthwhile to combine the digestion process on a band which forms the subject of the invention with the very old process of heap washing.

In this case, in fact, the mixture is discharged after digestion on the band, over a prepared area so as to form a heap and this heap is washed. This method is particularly worthwhile in the case where, as in Example 2, an oxidizing agent must be added to the mixture of ore and attacking reagent. The first phase of digestion required for reducing the concentration in free acid alone may then be carried out on a belt before adding the oxidizing agent. The second phase of digestion on the belt is then dispensed with and the mixture to which the oxidizing solution has been added is piled up on a prepared area. This prepared area is, for example, a slightly sloping layer of ground which has previously been sealed by means of a plastic foil for example, then covered by a filter layer formed for example by suitably crushed pebbles. A heap of mixture which may be of the order of 10 to 20 meters thick is placed on this area. This heap is preferably constructed so as to have a horizontal sharp edge on the top, the lateral walls of the heap joining this edge with slopes which are inclined in the manner corresponding to the natural fall of the mixture. Washing is carried out by spraying the heap in an open circuit along the upper edge by means of water, all as is known in the art.

It is seen that the process of digestion on a belt according to the invention is extremely simple and lends itself to a large number of variations in execution. Thus it is possible to adapt this process to the physico-chemical properties of the ores which are to be treated and also to the local conditions which are encountered.

Finally, more resistant materials than natural or synthetic rubber could be used for the belt, and for example, articulated belts formed by metallic elements which are resistant to corrosion such as certain stainless steels or certain special cast-irons. Metal rubber composites can also be considered. By substituting a much more resistant material for rubber, the thickness of the layer of ore could be increased considerably, thus possibly allowing the flow rate to be increased or the length of the course to be reduced. In this case, it would no longer be possible to use a single movable surface hollowed in the form of a groove as a support. It would be necessary to have recourse to a movable band composed of articulated elements which would be enclosed on each side by inclined or vertical walls which would themselves be mobile and which could either be articulated elements or perhaps rubber bands if they are not subjected to stresses which are too great. The hood required for reducing evaporation and thermal losses would then only be in contact with the upper ends of the lateral walls. This also could be composed of fixed or mobile elements. The thickness of the mixture circulating on the mobile band could then reach thicknesses of the order of 1 to 2 m and even possibly more.

The main advantage of this solution would be the great reduction in the length of the apparatus at the cost of greater complexity.

What is claimed as new and intended to be secured by Letters Patent is:

1. In a process for extracting uranium from uranium ore wherein the ore is first crushed so that a substantial portion of the grains are of a dimension not less than 0.1 mm, the improvement comprising the steps of sequentially (a) mixing the crushed ore with an attacking reagent, the volume of which is less than that required to produce a continuous liquid phase, (b) placing the mixture of crushed ore and attacking reagent on at least one conveyor belt at a predetermined temperature and humidity and allowing it to reside thereon for at least 1 hour, and (c) extracting the solubilized uranium from the mixture by washing.

2. A process as defined in claim 1, wherein an oxidizing reagent is added to the mixture of crushed ore and attacking reagent after residence on the conveyor belt of at least 1 hour.

3. A process as defined in claim 2, wherein the mixture is allowed to reside on said belt for at least one hour after the addition of the oxidizing reagent.

4. A process as set forth in claim 1, wherein the reagent is a sulphuric solution.

5. A process as set forth in claim 1, wherein the reagent is a hydrochloric solution.

6. A process as set forth in claim 1, wherein the reagent is an alkaline solution.

7. A process as set forth in claim 1, wherein the residence time of the treated crushed ore on said belt is between one and three hours and the temperature maintained is between 60° and 100° C.

8. A process as defined in claim 1, wherein after residence of the mixture on said at least one belt, it is piled in a heap and sprayed by a washing solution.

9. A process as defined in claim 8, in which before piling of the mixture in a heap, an oxidizing solution is added thereto.

* * * * *